United States Patent [19]

Imperial et al.

[11] 4,083,092

[45] Apr. 11, 1978

[54] SLEEVED ORGANIC RUBBER PRESSURE ROLLS

[75] Inventors: George R. Imperial, Webster; James A. Lentz, Penfield, both of N.Y.

[73] Assignee: Xerox Corporation, Stamford, Conn.

[21] Appl. No.: 803,095

[22] Filed: Jun. 3, 1977

[51] Int. Cl.[2] ..... B21B 31/08

[52] U.S. Cl. ..... 29/132

[58] Field of Search ..... 29/132

[56] References Cited

U.S. PATENT DOCUMENTS

| | | | |
|---|---|---|---|
| 2,333,800 | 11/1943 | Lewis et al. | 29/132 |
| 3,264,978 | 8/1966 | Staley et al. | 29/132 X |
| 3,449,548 | 6/1969 | Adamek et al. | 29/132 X |
| 3,662,446 | 5/1972 | Walls | 29/132 X |
| 3,686,731 | 8/1972 | Koori et al. | 29/132 |
| 3,912,901 | 10/1975 | Strella et al. | 29/132 X |
| 3,918,397 | 11/1975 | Thettu | 118/60 |
| 3,959,573 | 5/1976 | Eddy et al. | 29/132 X |
| 3,988,817 | 11/1976 | Thettu | 29/132 X |
| 3,989,005 | 11/1976 | Bowler et al. | 118/60 |

*Primary Examiner*—Alfred R. Guest

*Attorney, Agent, or Firm*—James J. Ralabate; Ernest F. Chapman

[57] ABSTRACT

A pressure roll for use in a roll fuser for fixing toner images to copy sheets by the application of heat and pressure, is described. The roll is characterized by a rigid core covered with a relatively thick layer of organic rubber with a relatively thinner sleeve or layer of material acting as an air barrier to the organic rubber to prevent oxidative degradation. The organic rubbers are characterized by small compression deflection decreases even after exposure to high temperatures, under pressure for prolonged periods of time. Highly cross-linked organic rubbers cured with non-sulfur crosslinking agents are preferred organic rubbers.

20 Claims, 2 Drawing Figures

SLEEVED ORGANIC RUBBER PRESSURE ROLLS

BACKGROUND OF THE INVENTION

This application relates to a heated pressure fusing apparatus used in xerographic copying machines and in particular to an improved pressure roll used in conjunction with a fuser roll for providing a nip through which copy sheets are moved so that toner images contact the fuser roll.

Generally in xerography, a xerographic surface comprising a layer of photoconductive insulating material affixed to a conductive backing is used to support electrostatic images. In the usual method of carrying out the process the xerographic surface is electrostatically charged uniformly across its surface and then exposed to a light pattern of the image being reproduced to thereby discharge the charge in the areas where the light strikes the layer. The undischarged areas of the layer thus form an electrostatic charge pattern in conformity with the configuration of the original light pattern. The latent electrostatic image is developed by contacting it with a finely divided electrostatically attractable powder (toner). The powder is held in image areas by the electrostatic charges on the layer. It is then transferred to a sheet of paper or other suitable surface and affixed thereto to form a permanent print.

There are various ways of fusing or affixing the toner particles to the support member, one of which is by the employment of heat. In order to affix or fuse electroscopic toner materials permanently onto a support member by heat, it is necessary to elevate the temperature of the toner material to a point at which the constituents of the toner material coalesce and become tacky. This action causes the toner to adhere to the support member. In both xerographic as well as the electrographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is either externally or internally heated. During operation of a fusing system of this type, the support member to which the toner images are electrostatically adhered, is moved through the nip formed between the rolls with the toner images contacting the fuser roll to effect heating of the toner images within the nip. In order to enhance fusing of the toner images in the foregoing manner, the pressure or backup roll of the fuser roll pair is usually constructed so that the fuser roll creates a depression in the pressure or backup roll as the result of a biasing force which forces the rolls into engagement. To this end the pressure or backup roll comprises a rigid core having a relatively thick resilient layer affixed thereto and an outer layer or sleeve of abhesive material. The abhesive material exhibits a low affinity for tackified toner. The aforementioned depression is continually formed as different portions of the pressure or backup roll move into and out of engagement resulting in a large number of flexures of the relatively thick resilient layer and the outer layer. The useful life of such pressure or backup rolls depends to a large degree on the ability of the materials forming the layers to withstand the strain of continued flexing.

Typical devices for fixing the toner particles to the sheet by a heated pressure fusing roll apparatus in which the copy sheet passes through the nip of a coated heated fuser roll and a pressure or backup roll are described for example in U.S. Pat. Nos. 3,256,002; 3,268,351; 3,841,827; and 3,912,901. In U.S. Pat. No. 3,912,901, Strella et al describe and claim pressure rolls comprising a rigid core; a layer of resilient material adhered to the rigid core; and an outer layer over the resilient layer, the outer layer comprising a copolymer of perfluoroalkyl perfluorovinyl ether with tetrafluoroethylene. Strella et al disclose that the elastomeric resilient material is a heat-resistant, organosiloxane polymer commonly known as silicone rubber. Silicone rubber is generally considered adequate for this purpose, and pressure rolls prepared with silicone rubber as the resilient layer generally perform as pressure rolls for a substantial number of hours, especially when coated with the sleeve material of a copolymer of perfluoroalkyl perfluorovinyl ether with tetrafluoroethylene as described by Strella et al. However, the pressure rolls having a silicone rubber resilient layer must be end capped so that the silicone rubber will not be impacted by silicone oil or fluids which are normally applied as offset preventing liquids or fluids to the outer surface of the fuser roll. When silicone rubber is exposed to silicone oil, the silicone rubber swells, and the integrity of the rubber deteriorates thereby decreasing its effectiveness under the pressures and temperatures normally encountered in the pressure fusing systems. Silicone oil applied to the fuser roll eventually carries over to the pressure roll causing the foregoing disadvantages unless the pressure rolls are end capped to prevent exposure of the silicone rubber resilient layer to silicone oil. This precaution results in added expense in the preparation of pressure rolls.

Furthermore, silicone rubbers encased in a sleeve inherently soften substantially with use, especially under the pressure and high temperatures required for the pressure fixing or fusing of toners. This softening reduces the useful and effective life of pressure rolls having a silicone rubber resilient layer.

Heretofore, copolymers of perfluoroalkyl perfluorovinyl ether and tetrafluoroethylene were preferred as an outer sleeve material to cover the silicone rubber resilient material adhered to the core of a pressure roll to provide adequate pressure roll life especially in high speed copiers. This type of pressure roll is described by Strella et al in U.S. Pat. No. 3,912,901. Strella et al indicate that for certain machines, fluorinated ethylene propylene (FEP) is appropriate as an outer layer for pressure rolls in certain machines, however, Strella et al indicate that as operating parameters of copiers, such as copier speed, increase significantly, the flex fatigue life of FEP sleeves is not satisfactory and FEP cannot be used as the outer sleeve over silicone rubber in pressure rolls.

Another disadvantage of the pressure rolls made with a silicone rubber resilient layer and an outer sleeve or layer of a copolymer of perfluoroalkyl perfluorovinyl ether and tetrafluoroethylene is the relatively high cost resulting from the expensive materials.

OBJECTS OF THE INVENTION

Accordingly, the principal object of this invention is to provide a new and improved copying apparatus.

It is a more particular object of this invention to provide a new and improved roll fusing apparatus for utilization in an electrostatic copier apparatus.

Yet another object of this invention is to provide new and improved pressure or backup rolls for a fusing apparatus.

Another object of this invention is to provide a pressure roll and method of making a pressure roll having substantially improved life over the life of the prior art pressure rolls.

Still another object of this invention is to provide a pressure roll which is not affected by the silicone oil used as an offset preventing fluid on fuser rolls.

Another object of this invention is to provide a pressure roll which does not have to be fitted with end caps to prevent the swelling of the resilient layer from silicone oil applied to the fuser roll as an offset preventing fluid, at least residual quantities of which transfer to the pressure roll and spread over the end portions of the pressure roll.

Another primary object of this invention is to provide a pressure roll having a resilient layer which does not substantially soften under the pressures and high temperatures required for the pressure fixing of toners.

It is another object of this invention to reduce the expense of the pressure roll materials and to make pressure rolls having longer useful lives at a lower initial cost.

SUMMARY OF THE INVENTION

Briefly, the above-cited objects are accomplished by the provision of a pressure or backup roll which comprises a composite structure including a rigid core; a layer of long-life, durable, non-softening organic rubber adhered to the rigid core; and an outer protective sleeve material having a high flex life over the organic rubber layer. The sleeve material provides a barrier to air so that the organic rubber is relatively free from oxidative degradation characteristic of organic rubbers under high pressures and high temperatures for extended periods of time.

The outer protective sleeve material also provides a layer of abhesive material which prevents molten or tacky toner from adhering to the heated surface, especially when used in conjunction with an offset preventing fluid, for example silicone oil, as is well known in the art.

The thickness of the resilient organic rubber layer and the abhesive outer sleeve material is such as to yield readily to the force (pressure) of the fuser roll structure.

The sleeve material can be any one or a combination of any well-known polymer or resinous materials which have a high flex life and which are impervious to air. The organic rubbers of the resilient layer are critical in the present invention. The organic rubbers are characterized by their compression deflection properties, and in accordance with the present invention, the compression deflection must not substantially decrease with time even at the operating temperatures and pressure of the fuser apparatus. Thus, the compression deflection decrease of the organic rubber resilient layer with time must be minimal, or alternatively stated, there is only a small amount of compression deflection decrease of the organic rubber resilient layer as time increases.

As used herein the term "organic rubber" is defined as a natural or synthetic rubber or elastomer or derivatives thereof characterized by a substantially carbon-containing base unit having carbon to carbon bonds. The carbon to carbon backbone may be unsaturated or saturated. This definition excludes the polysiloxane rubbers and elastomers.

In accordance with the present invention, there is also described a pressure roll for a roll fusing apparatus utilized in fixing toner images to support sheets, the pressure roll comprising a rigid core; a layer of crosslinked organic rubber adhered to the rigid core, the organic rubber being cured in a free radical crosslinking system comprising a free radical initiating agent; and an outer protective sleeve material having a high flex life over the organic rubber layer, the sleeve material providing a barrier to air so that the organic rubber is relatively free from oxidative degradation.

Further objects of this invention together with additional features and advantages thereof will become apparent from the following detailed description of the preferred embodiments of the invention when read in conjunction with the accompanying drawings.

DESCRIPTION OF THE PREFERRED EMBODIMENTS

Figure 1:
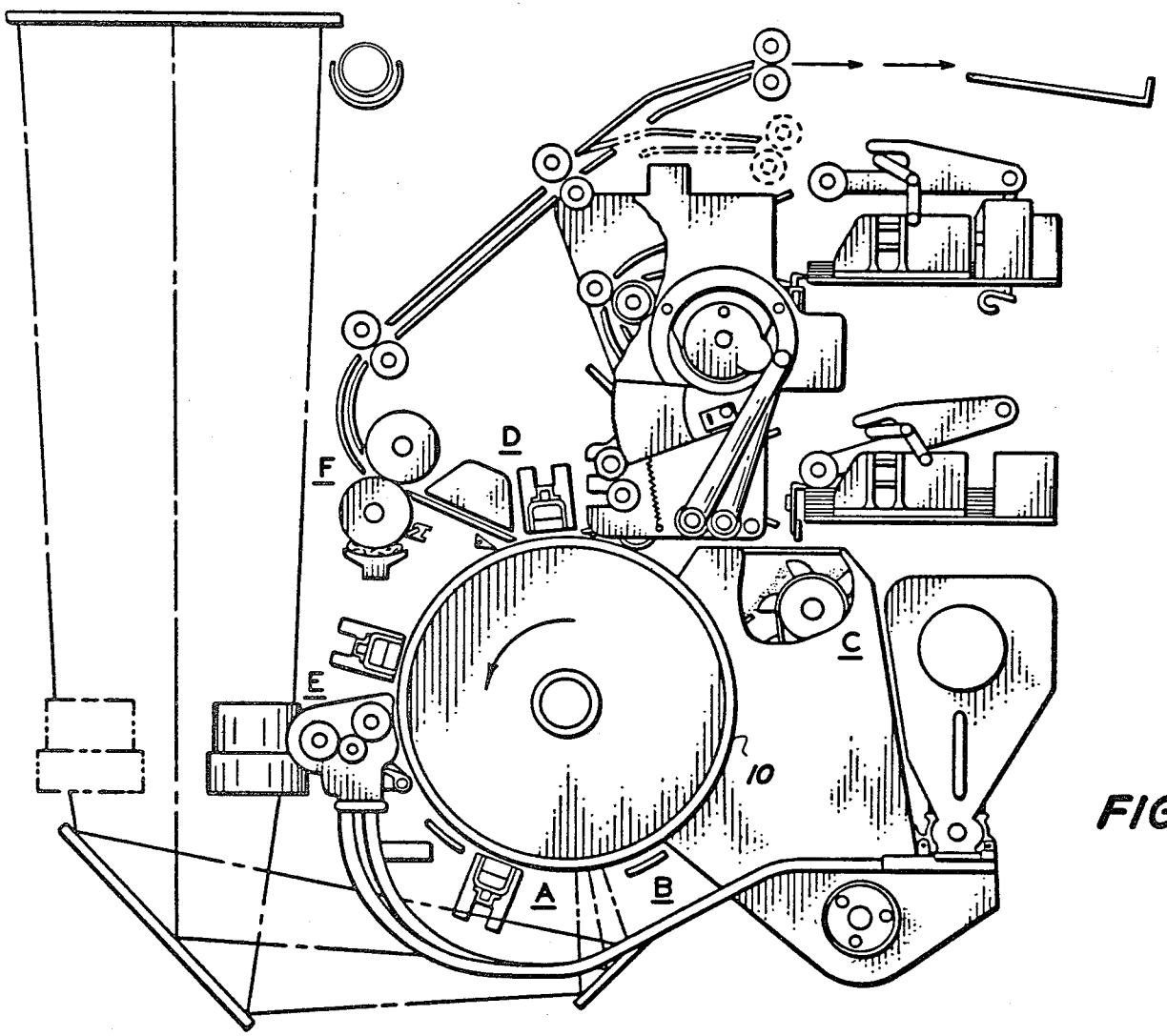
FIG. 1 is a schematic representation of an automatic xerographic reproducing machine incorporating a heated pressure fusing apparatus utilizing the improved pressure roll materials according to the present invention.

Referring now to FIG. 1 of the drawings there is shown an embodiment of the invention in a suitable environment such as an automatic xerographic reproduction machine. The automatic reproducing machine includes a xerographic plate 10 formed in the shape of a drum. The plate has a photoconductive layer or light receiving surface on a conductive backing and is journaled in a frame to rotate in the direction indicated by the arrow. The rotation causes the plate surface to pass sequentially through a series of xerographic processing stations. For purpose of the present disclosure and exemplary of a typical utility for the pressure or backup roll, the several xerographic processing stations in the path of movement of the plate may be described functionally as follows:

A charging station A where a uniform electrostatic charge is deposited onto the photoconductive drum;

An exposure station B at which a light or radiation pattern of a document to be reproduced is projected onto the plate surface to dissipate the charge in the exposed areas to form a latent electrostatic image of the document to be reproduced;

A developing station C at which xerographic developing material including toner particles having an electrostatic charge opposite to that of the latent electrostatic image is cascaded over the latent electrostatic image to form a powdered image in configuration of a document being reproduced;

A transfer station D at which the powdered image is electrically transferred from the plate surface to a transfer material such as paper which is then passed through a heated pressure fusing apparatus which has an improved pressure or backup roll according to the present invention as will be described more fully hereinafter as mounted in a fuser assembly; and A drum cleaning and discharge station E at which the plate surface is cleaned to remove residual toner particles remaining thereon and to discharge completely any residual electrostatic charge remaining thereon.

For further details of the xerographic processing stations described above, reference is made to U.S. Pat. No. 3,645,615 and U.S. Pat. No. 3,937,637.

Figure 2:
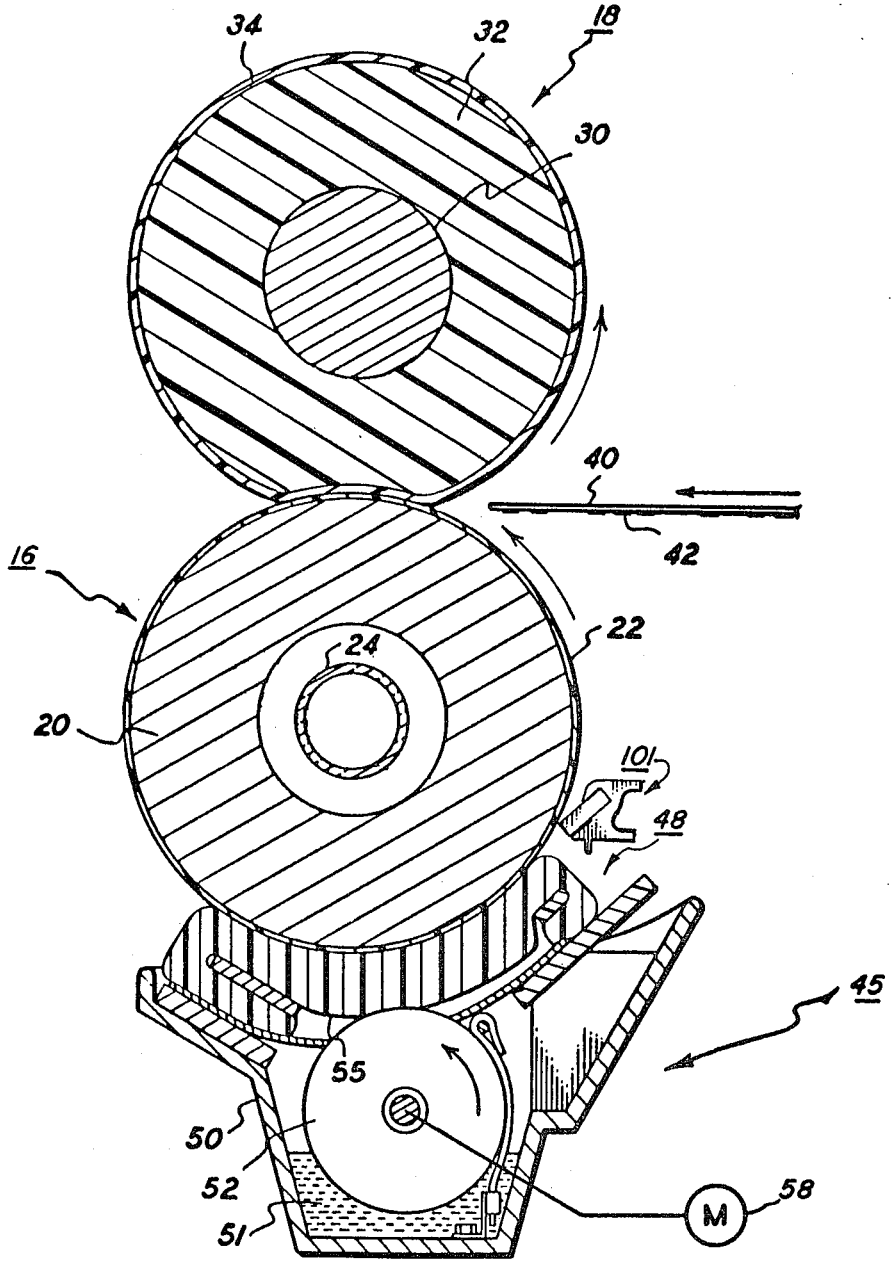
FIG. 2 is a side elevational view of a typical fusing apparatus including fuser roll, oil metering assembly and pressure roll utilizing the improved resilient layer of the present invention.

Referring now in particular to FIG. 2, there is shown a typical heated pressure fusing apparatus which includes the improved pressure or backup roll 18 of the present invention. The heated pressure fusing apparatus includes a heated fuser roll 16 and a backup or pressure roll 18. The fuser roll is a hollow circular cylinder including a metallic core 20 which is covered with a layer 22 made out of Teflon, a trademark of duPont Corporation of Wilmington, Del. or other suitable materials known in the art. A quartz lamp 24 located inside of the fuser roll is a source of thermal energy for the fusing apparatus. Power to the lamp is controlled by a thermal sensor (not shown) which contacts the periphery of the fuser roll as described for example in U.S. Pat. No. 3,357,249. The pressure or backup roll is also a circular cylinder and is made up of a metal core 30 surrounded by a thick organic rubber layer 32 and then by another layer 34 made of Teflon or other suitable material to prevent the permeation of air into the layer 32 and subsequent oxidation degradation thereof.

As discussed above, the fuser roll structure 16 with an outer surface which has a relatively low affinity for tackified toner particles, a fluorocarbon polymer layer 22 of, for example, tetrafluorethylene (abbreviated TFE) is provided on the rigid cylindrical member 20. The TFE layer may be on the order of 1.0 - 1.5 mils thick, and the member 20 is preferably fabricated from a thermally conductive material such as copper or aluminum. When copper is employed, it should be coated with aluminum or nickel prior to the application of the TFE. The particular manner in which the fuser roll structure 16 is fabricated forms no part of the present invention. Accordingly, such fabrication thereof may be in accordance with well-known processes, for example, those set forth in U.S. Pat. Nos. 3,437,032 and 3,776,760. While the fuser structure is disclosed as having a TFE layer, it may be fabricated without the layer and may simply comprise a bare metal surface, or the surface may be covered with a thin elastomeric layer.

Although end caps or closures (not shown) may be used at the ends of pressure roll 18 as illustrated in U.S. Pat. No. 3,912,901, incorporated herein by reference, the end caps or closures are not required on the pressure rolls of the present invention because the organic rubber layer 32 adhered to the rigid core 30 does not swell from silicone oil used as an offset preventing fluid 51 metered onto fuser roll surface 22, residual quantities of which transfer from fuser roll 16 to pressure roll 18.

When the two rollers 16 and 18 are engaged as shown in FIG. 2, the applied load deforms the rubber in the pressure roll to provide the nip with a finite width. A copy sheet 40 electrostatically bearing the toner images 42 on the underside is brought into contact with the nip of the rolls and with the toner images contacting the fuser roll surface. The mechanism for driving the rolls and for lowering and raising rolls into contact can be accomplished by any suitable means such as that described for example in U.S. Pat. No. 3,291,466 or any suitable mechanical camming device. As a sheet of material is advanced between the rolls 16 and 18 the toner images on a support material are contacted by the peripheral heated surface of the rolls 16 causing the toner images to become tackified which would tend to cause the toner to offset onto the roll except that it is partially prevented from doing so by the Teflon or other coating on the roll and by the thin film of offset preventing fluid such as silicone oil, and is applied to the surface of the roll by an oil dispensing apparatus generally designated 45. Oil dispensing apparatus 45 includes a wicking assembly 48, an oil pan 50 for maintaining a supply of silicone oil 51, and an applicator roll 52 which is driven by an oil dispensing motor 58 during the fusing operation. The use of an offset preventing fluid on the fuser roll and the particular manner of applying the offset preventing fluid forms no part of the present invention, and well-known offset preventing techniques may be adapted for use with the instant invention.

Other typical fusing apparatuses which necessitate the metering of offset preventing fluid on the fuser member surface are well known in the art. For example, in U.S. Pat. No. 3,937,637 the polyethylene and other polymer release materials applied to the surface of the bare metal fuser rolls can be metered by the metering blade constructed of a fluoroelastomer copolymer of vinylidene fluoride and hexafluoropropylene and having at least one surface contacting edge having a radial curve extending longitudinal the contacting edge. In U.S. Pat. No. 3,912,901, incorporated herein by reference, there is disclosed another typical fuser system wherein there is claimed a pressure roll having a rigid core, a layer of resilient material adhered to the core, and an outer layer over the resilient layer, the outer layer comprising a copolymer of perfluoroalkyl perfluorovinyl ether with tetrafluoroethylene. Silicone rubber is disclosed as the resilient layer in U.S. Pat. No. 3,912,901, and exemplary mounting means, offset preventing fluid applicator means and other machine parameters are disclosed therein.

In certain preferred embodiments the pressure or backup roll has approximately the same overall dimensions as the fuser roll structure, and it comprises a rigid, generally cylindrical core element 30 having an outside diameter of about 1½ inches (3.8cm). A 0.73 inch (1.85cm) layer 32 of organic rubber material preferably a heat-resistant, long-life, durable, non-softening organic rubber is adhered to core 30. A 0.019 inch (0.05cm) outer layer or sleeve 34 of high heat-resistant, air impermeable material having a relatively low affinity for tackified toner is provided over the organic rubber layer. The combined thickness and durometer of the layers 32 and 34 is such as to allow for deformation thereof by the fuser roll structure in order to yield a suitable length for the nip formed between pressure roll 18 and fuser roll 16, (i.e. an area coextensive with the concave portion of the backup roll). A felt pad (not shown) and support therefor (not shown) may be supported to the fuser assembly frame so that the pad contacts the surface of the backup roll. Thus, any contamination such as toner may be removed from the backup roll during its rotation.

It will be appreciated that as portions of the pressure or backup roll pass through the nip area, the layers 32 and 34 are mechanically stressed due to the flexing thereof. At the present time the useful life of a prior art structure such as the backup roll 18 appears to be limited by the failure of the resilient silicone rubber layer 32, the main mode of failure being the cohesive failure of the rubber, that is the rubber splits or ruptures for any of various reasons due to softening from extended use and/or heat build-up within the rubber and the like.

Although the prior art pressure rolls exemplified by U.S. Pat. No. 3,912,901 perform well, especially with the sleeves having a high flex life, the compression deflection characteristics of the silicone rubber resilient layer are such that the failure of the rolls relates to the silicone rubber, especially in view of increased copier speeds. As copier speed increases significantly, the compression deflection of the silicone rubber layer substantially decreases with time causing failure of the rubber and decreased fusing performance due to the resulting nip width and nip pressure changes.

In order to increase the life of the pressure or backup roll, it has been found that organic rubbers can be used as the resilient layer in the pressure roll. More specifically, organic rubbers which have a compression deflection change of less than 10% after prolonged use, for example operating at a nip pressure of about 100–200 pounds per square inch at 320° F (160° C) for 100 hours, increase the life of the pressure roll by two to five times over the pressure rolls having silicone rubber as a resilient layer. In accordance with the present invention the compression deflection decrease is critical, and when an organic rubber has a compression deflection decrease of less than about 10% after operating at a nip pressure load of about 110 pounds per square inch at 320° F (160° C) for 100 hours, the organic rubber will produce the improved pressure roll when it is adhered to a rigid core and covered with an outer protective layer of high flex life material which provides a barrier to air. When air is excluded from the organic rubbers, the rubbers are generally relatively free from oxidative degradation which can cause deterioration of rubber integrity and shortened life.

Compression deflection is an empirical measurement used to measure the overall hardness of a pressure roll and is the force required in pounds to depress or deflect the composite roll a specified distance. Typically, a circular foot, e.g., 1 inch (2.5cm) wide, is deflected a certain distance into the roll and the force required to achieve this compression deflection is recorded.

Flex fatigue life is defined as the number of cycles a strip of material, for example FEP, PFA Teflon, TFE, etc. will undergo before splitting when flexed under specified conditions, for example, 90° under 10% strain between two gripper jaws at an elevated temperature, e.g., 20 mil radius jaws at 330° F (116° C.) Known materials such as the FEP employed in the production of prior art backup rolls provide rolls having sleeves or outer layers whose flex life is on the order of 10,000 to 60,000 cycles. The improved sleeve material of U.S. Pat. No. 3,912,901, a copolymer of perfluoroalkyl perfluorovinyl ether and tetrafluoroethylene, yield 1.5 million flex fatigue cycles. In accordance with the present invention, commonly known sleeve materials of desired thicknesses may be used to coat the pressure rolls. These include FEP, TFE, PFA Teflon, fluoroelastomer copolymer and the like. Preferred thicknesses range from about 5.0 mils to about 30 mils.

The organic rubbers useful as the resilient layer adhered to the rigid core of the pressure rolls of the present invention must be the organic rubbers characterized by only minimal compression deflection decreases with time. This measurement has been described above. Exemplary of this class of long-life, durable, non-softening organic rubbers are chloroprene rubber, nitrile rubber, isoprene rubber, chlorobutyl rubber, ethylene propylene terpolymer rubber (EPDM), butadiene rubber, ethylene propylene rubber, butyl rubber, butadiene/acrylonitrile rubber, ethylene acrylic rubber, styrene butadiene rubber and synthetic polyisoprene rubber.

Among the organic rubber compositions which are useful in accordance with the present invention, and which have only slight or minimal compression deflection decrease, for example less than 10%, with time, are those crosslinked organic rubbers which are cured in a free-radical crosslinking system comprising a free radical initiator. Exemplary of such a system is a peroxide-cured organic rubber. These organic rubber crosslinking systems are non-sulfur curing systems, and organic rubbers which are sulfur-cured are less desirable and generally do not meet the compression deflection decrease requirements of the present invention. Examples of free radical initiators are dicumyl peroxide, azobisisobutyronitrile, 1,3-diphenylquanidine, $\alpha\alpha^1$ bis(t-butylperoxy) diisopropyl benzene, benzoyl peroxide, 2,5-dimethyl-2-5-bis (t-butylperoxy) hexane or hexyne-3, and di-t-butyl peroxide.

In another preferred organic rubber composition found useful as a resilient layer in pressure rolls according to the present invention are the organic rubbers which are crosslinked or cured in a system or process where the free radical crosslinking is carried out in the presence of a co-agent which is a reactive monomer itself and which adds to the polymer radical formed by the free radical initiator. This type of coagent promotes trimolecular crosslinking. Triallyl cyanurate and triallyl isocyanurate are exemplary of such coagents which promote trimolecular crosslinking, that is, which join three, rather than merely two, polymer chains together. Examples of other coagents include trifunctional acrylates such as trimethyl propane trimethacrylate, N,N$^1$-m-phenylenediamulimide, butylenedimethacrylate, 1,2-polybutadiene, organotitanates, pentaerythritol tetramethacrylate, and trifunctional organosiloxanes.

The basic mechanism for the free radical crosslinking used in the curing of the organic rubbers in accordance with the present invention is well known in the art. Although the invention is not limited to any particular theory, the peroxide thermally decomposes homolytically to form free radicals which then react with the polymer by addition or abstraction to form radicals on the polymer backbone. The two polymer radicals can then combine to form the desired, thermally stable carbon-carbon bonds. Since polymer free radicals are energetic, and many polymers (particularly polypropylene and propylene copolymers) will undergo chain scission or cleavage reactions leading to molecular weight reductions and property loss, in preferred embodiments certain coagents may be used to prevent or to take advantage of this energetic activity of the free radicals. The function of the coagents is to increase the efficiency of the crosslinking reaction by adding to the polymer radical favoring trimolecular crosslinking. The coagent function is shown below:

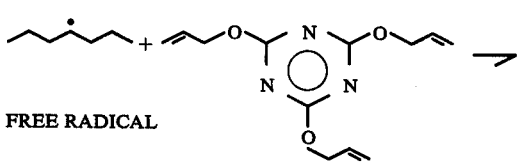

-continued

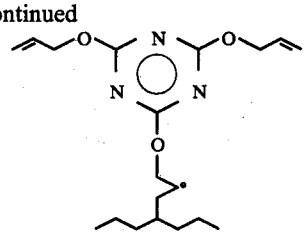

TRIMOLECULAR CROSSLINK

As illustrated above, the coagent becomes a part of the polymer chain. It is for this reason that it is designated a reactive monomer coagent or a reactive comonomer.

One preferred composition for the layer of crosslinked organic rubber adhered to the rigid core, is an organic rubber composition comprising an organic rubber; about 10 to about 100 parts by weight or a particulate, surface-active filler per 100 parts of organic rubber; about 10 to about 100 parts by weight plasticizing agent per 100 parts of organic rubber; about 5 to about 40 parts by weight of a cure activator per 100 parts of organic rubber; and about 0.5 parts to about 3.0 parts by weight antioxidant per 100 parts of organic rubber; the organic rubber composition being heat cured in the presence of a free radical initiator agent and a reactive monomer coagent which adds to the polymer radical. Fillers, plasticizers, cure activators, antioxidants, and other additives well known in the art of compounding rubber compositions may be incorporated in the organic rubber compositions to provide more desirable characteristics and properties. More detailed characteristics of these additives and their effect on the organic rubber can be found under the topic of "Rubber Compounding" and "Rubber Chemicals" in Volume 17 of the Kirk-Othmer, *Encyclopedia of Chemical Technology*, pp. 510–660.

Fillers or reinforcing agents may be added to increase the strength and integrity of the organic rubber. Carbon blacks, silicas and the like may be added to increase abrasion resistance, tensile and tear strength and fatigue resistance. The concentration of the surface-active filler is a function of the hardness or the compression deflection. In compounding the organic rubber the desired compression deflection may be attained by adjusting the concentration of the surface-active filler and the plasticizer. Generally, about 30 to about 60 parts by weight of filler material per 100 parts of organic rubber are preferred in rubbers of the present invention to yield a rubber of about 35 – 55 Shore A2 durometer hardness. Generally, most grades of carbon black are commonly used as reinforcing agents. Clays, silicas, calcium silicate, zinc oxide and the like are examples of non-black fillers.

Plasticizers may also be used in the preferred organic rubber compositions of the present invention. The plasticizers contribute to the relatively low hardness, for example 30 – 60 parts plasticizer will yield a Shore A2 hardness of about 45–55. Petroleum-based process oils are commonly used for this purpose. Highly refined, principally paraffinic oils with high aniline points are best suited for use in the peroxide crosslinked system. Generally, about 40 to 60 parts by weight plasticizer and about 50 parts carbon black per 100 parts of organic rubber are preferred to provide a 40–50 Shore A2 durometer. Exemplary plasticizers are derived from petroleum, coal tars, pine tars or resins, ester-plasticizers, liquid rubbers, fats and oils, and synthetic resins. Chemical plasticizers are well known in the art.

The concentration of black required is a function of the hardness, the amount of plasticizer used and the overall property balance desired. Using 45 Shore A as a target value, a level of about 40 – 50 phr (parts per 100 parts rubber) provides an adequate property balance. Other compounding ingredients, particularly the cure/coagent ingredient may effect hardness.

Various plasticizer/carbon black combinations are possible while maintaining constant hardness. Other factors such as tensile strength, compound economics, dynamic heat buildup, adhesion interactions, processability, etc., determine the degree of extension tolerable. Table 1 shows that at constant carbon black levels a higher plasticizer content results in an increased internal heat buildup ($\Delta T$) on flex. It is believed that this is due to increased loss in the polymer network being transformed into heat. Excessive hysteresis loss can lead to internal fractures and cohesive rubber failure because of the generation of heat.

Cure activators may be added to the organic rubber composition to serve as long term aging protectants and to shorten cure time. Zinc oxide is one of the preferred cure activators, however any well-known cure activators may be used in the present invention and include magnesium oxide, $Fe_2O_3$, cadium oxide and lead oxide.

Zinc oxide has been long recognized for its exceptional performance as an additive for preventing heat degradation of natural and synthetic polymers.

Zinc oxide is available in many physical forms in the rubber industry. A number of concentrated masterbatches, propionic acid-coated and dry blend formulations are in use and enhance dispersion characteristics in a polymeric matrix. Experiments have shown that two dry forms of zinc oxide and 90% active dry dispersion on clay provide acceptable results in the formulation. About 5 to about 40 parts by weight cure activator per 100 parts organic rubber is a preferred range for the organic rubber composition of the present invention.

Antioxidants are also commonly used in the compounding of rubbers, and in the organic rubbers of this invention, it is generally preferred to use about 0.5 to about 3.0 parts by weight antioxidant per 100 parts of organic rubber. Examples of antioxidants include such secondary aromatic amines as diphenylamine, N-phenyl-2-naphthylamine, N,N'-diphenyl-p-phenylenediamine, 2,2'-methylene-bis-(4-ethyl-6-t-butyl phenol), tri(nonylated phenyl) phosphite, and the like. One preferred antioxidant is polymerized 1,2-dihydro2,2,4-trimethyl quinoline manufactured by the R. T. Vanderbuilt Co. under the trade designation AgeRite Resin D. It is the most commonly used antioxidant in peroxide-cured ethylene propylene terpolymer formulations due to compatability with free radical (peroxide) cure systems. Alternative antioxidants such as substituted phenols, aromatic amines, etc. are very effective radical traps and therefore significantly retard peroxide-initiated cures. A preferred concentration of AgeRite Resin D is 1.0 part by weight per 100 parts of the organic rubber.

The adhesive used to adhere the organic rubber to the core and to adhere the sleeve to the organic rubber is not a part of this invention, and techniques well known in the art may be used to obtain the proper adhesion. One preferred metal primer/rubber adhesive system is Chemlok 205/236 which may be applied to the metal core. Chemlok 250 is a reliable adhesive for holding the protective sleeve to the organic rubbers. Chemlok is a tradename of Hughson Chemical Company. The rubber composition may be placed upon the core in any suitable manner, one of the preferred methods being the extrusion of the uncured organic rubber into a mold. The curing is then effected by placing the mold in a forced-air oven at elevated temperatures. The cure should be carried out for a time sufficient to reach an adequate state of cure at the core/rubber interface. One preferred curing time and temperature is about 4 – 7 hours in an oven at 340° F (171° C). Faster cures can be obtained by increasing the oven temperature or with molds of different designs that would permit more efficient heat transfer. Maximum cure temperature is limited to the rubber degradation temperature and attendant property losses. Curing techniques and procedures can be easily worked out by one skilled in the art.

The following examples further define, describe and compare exemplary organic rubbers for pressure rolls. Tests were carried out on fixtures taken from a Xerox 9200 duplicator (Xerox is a registered trademark of Xerox Corporation). The test fixtures comprise fuser assemblies similar to the assembly shown in FIG. 2 with minor variations. Pressure rolls having various resilient rubber layers were tested. The test rolls were set to a 0.67 inch (1.7cm) nip with no end cooling and were 15 inches in length and 3 inches in diameter. The tests were run at speeds characteristic of the Xerox 9200 duplicator and were continuous. Unless otherwise specified, the tests were conducted with fuser rolls set at 320° F (160° C). The speed of the pressure roll engaged under 1000–1200 pounds total load was 120 rpm or 7200 copies per hour.

Pressure rolls were made by extruding the rubber into a mold holding the primed metallic (steel) core. and the primed PFA Teflon sleeve. The rubber was cured in an oven at 340° F (171° C) for 5 hours. Generally sleeves of 20 mils thickness may be adhered to the rubbers by conventional techniques.

EXAMPLE I

Rigid steel cores were coated with ethylene propylene diene rubber (EPDM) supplied by B. F. Goodrich under the tradename EPCAR 346 using a two-part adhesive material at the metal/rubber interface and simultaneously covered with a 20 mil PFA Teflon sleeve. This rubber had a high crosslink density after curing. Four rolls having the EPDM rubber resilient layer were placed in test fixtures as described above. The rolls attained lifetimes greater than 500 hours. Two of the rolls were run at the standard fixture set point of 320° F (160° C) and two of the rolls were run up to greater than 200 hours at the standard fixture set point of 320° F (160° C) and additionally for greater than 250 hours at 360° F (180° C). The rolls were retired after 500 hours with no failures. Silicone oil was applied to the fuser roll as a release agent. No problems were observed from silicone oil contact with the pressure roll.

Under the same conditions a roll made in a manner similar to the above rolls with silicone rubber replacing the EPDM rubber, the rubber had a life of only 80 hours, the tests being terminated as a result of cohesive rubber failure.

EXAMPLE II

Pressure rolls were prepared as in Example I using polychloroprene (Neoprene) rubber as the resilient organic rubber layer. One Neoprene roll coated with a PFA Teflon protective outer layer exceeded 500 hours in the fixture test with no failure. Another Neoprene rubber roll was removed after 300 hours for sleeve debonding (not a rubber failure).

EXAMPLE III

Rolls were made as in Example I using chlorobutyl rubber as the resilient layer. The rolls were made with chlorobutyl base rubber (uncured) supplied by Exxon under the trade designation Exxon 1066. The cured rolls varied in performance, and rolls of chlorobutyl rubber appearing to have a higher crosslink density (based upon lower compression set and low elongation) were run in test fixtures in excess of 300 hours. Rolls in which the chlorobutyl rubber appeared to have a lower crosslink density failed within 3 hours in the test fixtures.

EXAMPLE IV

Rolls similar to those of Example III were made using nitrile rubber. The rolls were coated with base rubbers supplied by B. F. Goodrich under the trade designation BFG 1092 and Goodrich NG12. Observations similar to those of Example III were made for the pressure rolls having a neoprene rubber resilient layer and a PFA Teflon protective coating.

EXAMPLE V

To ethylene (74 mole %) propylene (24 mole %) and a nonconjugated diene, 5-ethylidene-2-nonbornene (about 2 mole %) known as EPDM and supplied by B. F. Goodrich under the trade designation EPCAR 346 was added a carbon black (ASTM N-550); a nonstaining paraffinic oil plasticizer supplied by Sun Oil Company under the trade designation Sunpar 150 oil; zinc oxide cure activator; polymerized 1,2-dihydro-2,2,4-trimethyl quinoline antioxidant supplied by R. T. Vanderbilt Company under the trade designation AgeRite Resin D; dicumyl peroxide free radical initiator agent (crosslinking agent) supplied by Hercules, Inc. under the trade designation DiCup 40C (a 40% active form); and triallyl cyanurate reactive monomer as a coagent used in conjunction with the peroxide free radical initiator supplied by American Cyanamid. The ingredients were added to the formulation in the quantities designated in Table 1 below which compare the effect of plasticizer/-carbon black filler on the physical properties of the EPDM rubber. The rubbers were cured for 5 hours in an oven at 340° F (171° C). Quantities are shown in parts by weight per 100 parts of EPDM.

TABLE 1

EFFECT OF PLASTICIZER/CARBON BLACK RATIO ON PHYSICAL PROPERTIES OF EPDM

| FORMULATION | A | B | C | D | E |
|---|---|---|---|---|---|
| EPDM | 100 | 100 | 100 | 100 | 100 |
| N550 Carbon Black | 30 | 30 | 40 | 45 | 45 |
| Plasticizer | 40 | 55 | 50 | 40 | 60 |
| Zinc Oxide | 10 | 10 | 10 | 10 | 10 |
| Antioxidant | 1 | 1 | 1 | 1 | 1 |
| Coagent | 2 | 2 | 2 | 2 | 2 |
| Initiator | 10 | 10 | 10 | 10 | 10 |
| Mechanical Properties | | | | | |
| Hardness, A | 46 | 38 | 45 | 54 | 40 |
| C/D (15%) | 78 | 59 | 68 | 100 | 60 |
| 100% M, (psi) | | | 155 | | |
| 300% M, (psi) | | | 705 | | |

TABLE 1-continued

EFFECT OF PLASTICIZER/CARBON BLACK RATIO ON PHYSICAL PROPERTIES OF EPDM

| FORMULATION | A | B | C | D | E |
|---|---|---|---|---|---|
| Elong. % | | | 420 | | |
| Tensile (psi) | | | 1180 | | |
| Tear, (pli) | | | 75 | | |
| Heat Buildup, ΔT (F°) | 39° | 46° | 52° | 54° | 61° |

C/D = compression deflection in pounds
M = modulus in pounds per square inch
Elong. = elongation in percent As shown in Table 1 various plasticizer/carbon black combinations are possible while maintaining constant hardness. Other factors such as tensile strength, compound economics, dynamic heat buildup, adhesion interactions, processability, etc., determine the degree of extension tolerable. Table 1 shows that at constant black levels a higher plasticizer content results in an increased internal heat buildup (ΔT) on flex.

Pressure rolls having resilient rubber layers made from Formulation A-C and E in Table 1 were prepared as the rolls in Example I. All four rolls coated with PFA Teflon performed greater than 500 hours in the test fixtures.

EXAMPLE VI

Rubber formulations were prepared as in Example V to study the effect of the coagent/peroxide initiator on the EPDM rubber. Quantities in parts by weight per 100 parts of EPDM and comparisons of mechanical properties for four formulations are shown in Table 2 below.

TABLE 2

EFFECT OF REACTIVE MONOMER COAGENT AND/OR VARYING PEROXIDE CONCENTRATION ON PHYSICAL PROPERTIES

| FORMULATIONS | A | B | C | D |
|---|---|---|---|---|
| EPDM | 100 | 100 | 100 | 100 |
| N550 Black | 40 | 40 | 40 | 40 |
| Plasticizer | 50 | 50 | 50 | 50 |
| Zinc Oxide | 10 | 10 | 10 | 10 |
| Antioxidant | 1 | 1 | 1 | 1 |
| Coagent | 2 | none | 2 | 2 |
| Initiator | 10 | 10 | 7 | 13 |
| PROPERTIES | | | | |
| Durometer, A | 45 | 39 | 39 | 47 |
| C/D | 68 | 54 | 54 | 71 |
| 100% Mod | 155 | 105 | 105 | 185 |
| 300% Mod | 705 | 285 | 345 | 980 |
| Elongation | 420 | 830 | 665 | 320 |
| Tensile Strength | 1180 | 1175 | 1055 | 1080 |
| Tear, DieC | 75 | 100 | 90 | 65 |
| ΔT (° F) | 52° | 102° | 87° | 38° |

The physical effects of the low state of cure which results from the absence of coagent and/or decreased peroxide initiator concentration is clearly shown in Table 2. In comparison to the control formulation (A) compounds prepared with no coagent, (B) and with a 30% peroxide reduction (C) show very low state of cure as is evidenced by reduced durometer and modulus properties and increased tear and extensibility. The dynamic heat buildup (ΔT) is very strongly influenced by crosslink density as these compounds clearly show.

Pressure rolls were made according to Example I using the rubber formulations of Table 2. Roll A performed for over 500 hours in the test fixture; rolls B and C had cohesive rubber failure; and roll D failed but not due to rubber failure. Roll D failed because of debonding. Failure to run in the test fixture for 100 hours constitutes failure of the pressure roll.

EXAMPLE VII

Pressure rolls were prepared with EPDM rubber as the resilient rubber layer in accordance with the techniques described in Example I. The rubber layer was covered with a preformed sleeve of various coating materials. A suitable adhesive may be used to bond the sleeve to the rubber. The sleeves had a thickness of about 20 mils. Sleeve materials included:

(1) fluorinated ethylene propylene (FEP)
(2) PFA Teflon

Each of the foregoing rolls had a lifetime of over 500 hours when operated in the test fixture.

The data from the foregoing examples show that pressure rolls can be prepared from long-life, durable, non-softening organic rubbers adhered to a rigid core and covered by an outer protective sleeve. When the organic rubbers having a compression deflection decrease of less than about 10% after operating in the test fixture for 100 hours, are covered with PFA Teflon (copolymer of perfluoroalkyl perfluorovinyl ether and tetrafluoroethylene) sleeve materials, substantially improved lifetimes can be achieved because of the nature of the resilient organic rubber layer. It is significant that there is little decrease in the compression deflection value of the resilient organic rubber layer during the lifetime of the pressure roll.

It has also been shown that one of the parameters which can impact the property of the organic rubber so that there is only minimal decrease (less than 10%) in compression deflection during the lifetime of the pressure roll, is the crosslink density of the organic rubber, and organic rubbers having high crosslink density prolong the lifetime of the pressure rolls a significant amount of time. As shown in the examples, this parameter can be controlled by the curing agents used to cure or crosslink the rubber.

In accordance with the stated objects, there has been demonstrated an improved pressure or backup roll for a fusing apparatus. The improvement is realized by using the designated classes of organic rubbers as the resilient layer of the pressure roll resulting in increased pressure roll lifetimes and reduced cost because the organic rubbers are cheaper than the silicone rubbers and because there is less down-time required for replacing pressure rolls. The use of the specified organic rubbers also permits the use of conventional sleeve or coating materials, and furthermore, the specified organic rubbers are not attacked or deteriorated by the silicone oil offset preventing liquids used in the fuser system.

While the invention has been described with respect to preferred embodiments, it will be apparent that certain modifications and changes can be made without departing from the spirit and scope of the invention and therefore, it is intended that the foregoing disclosure be limited only by the claims appended hereto.

What is claimed is:

1. A pressure roll for a roll fusing apparatus utilized in fixing toner images to support sheets, the pressure roll comprising:

a rigid core;

a layer of crosslinked organic rubber adhered to the rigid core, the organic rubber being cured in a free radical crosslinking system comprising a free radical initiating agent; and an outer protective sleeve material having a high flex life over the organic rubber layer, the sleeve material providing a barrier is relatively free from oxidative degradation.

2. The pressure roll of claim 1 wherein the peroxide free radical initiating agent is dicumyl peroxide.

3. The pressure roll of claim 1 wherein the organic rubber is cured in a system further comprising a coagent to increase the efficiency of the crosslinking reaction, the coagent being a reactive monomer which adds to the polymer radical.

4. The pressure roll of claim 3 wherein the coagent is a reactive monomer which promotes trimolecular crosslinking.

5. The pressure roll of claim 3 wherein the coagent is triallyl cyanurate.

6. The pressure roll of claim 3 wherein the coagent is triallyl isocyanurate.

7. The pressure roll of claim 3 wherein the coagent comprises about 0.5 to about 3.0 parts by weight per 100 parts of organic rubber.

8. The pressure roll of claim 1 wherein the peroxide free radical initiating agent comprises about 8 to about 15 parts (40%) active form) by weight per 100 parts by weight per 100 parts of organic rubber.

9. A pressure roll for a roll fusing apparatus utilized in fixing toner images to support sheets, the pressure roll comprising:

a rigid core;

a layer of crosslinked organic rubber adhered to the rigid core, the organic rubber composition comprising: an organic rubber; about 10 to about 100 parts by weight of a particulate, surface-active filler per 100 parts of organic rubber; about 10 to about 100 parts by weight plasticizing agent per 100 parts of organic rubber; about 5 to about 40 parts by weight of a cure activator per 100 parts of organic rubber; and about 0.5 parts to about 3.0 parts by weight antioxidant per 100 parts of organic rubber; the organic rubber composition being heat cured in the presence of a free radical initiator agent and a reactive monomer coagent which adds to the polymer radicals; and an outer protective sleeve material having a high flex life over the organic rubber layer, the sleeve material providing a barrier to air so that the organic rubber is relatively free from oxidative degradation.

10. The pressure roll of claim 9 wherein the free radical initiator comprises about 8 to about 15 parts by weight (40% active) per 100 parts of organic rubber.

11. The pressure roll of claim 9 wherein the coagent comprises about 0.5 to about 3.0 parts by weight per 100 parts of organic rubber.

12. The pressure roll of claim 9 wherein the organic rubber is selected from the group consisting of chloroprene rubber, nitrile rubber, isoprene rubber, butyl rubber, chlorobutyl rubber, ethylene propylene diene rubber, ethylene propylene rubber, butadiene rubber, butadiene/acrylonitrile rubber and ethylene acrylic rubber.

13. The pressure roll of claim 9 wherein the particulate, surface-active filler is carbon black.

14. The pressure roll of claim 9 wherein the plasticizing agent is a petroleum based, nonstaining paraffinic oil.

15. The pressure roll of claim 9 wherein the cure activator is zinc oxide.

16. The pressure roll of claim 9 wherein the antioxidant is selected from the group consisting of aromatic amines, substituted phenols and polymerized 1,2-dihydro-2,2,4-trimethyl quinoline.

17. The pressure roll of claim 9 wherein the free radical initiator is dicumyl peroxide.

18. The pressure roll of claim 9 wherein the reactive monomer coagent is selected from the group consisting of triallyl isocyanurate.

19. A pressure roll for a roll fusing apparatus utilized in fixing toner images to support sheets, the pressure roll comprising:

a rigid core;

a layer of crosslinked organic rubber adhered to the rigid core, the organic rubber composition comprising: ethylene propylene diene rubber; about 35 to about 55 parts by weight carbon black per 100 parts of rubber; about 45 to about 55 parts by weight petroleum based paraffinic oil plasticizer per 100 parts of rubber; about 15 to about 30 parts by weight zinc oxide per 100 parts of rubber; and about 0.5 to about 2.0 parts by weight polymerized 1,2-dihydro-2,2,4-trimethyl quinoline; the organic rubber composition being heat cured in the presence of about 8 to about 13 parts by weight dicumyl peroxide per 100 parts of rubber with about 1.0 to about 3.0 parts by weight triallyl cyanurate per 100 parts of rubber; and an outer protective sleeve material having a high flex life over the ethylene propylene diene rubber layer, the sleeve material providing a barrier to air so that the organic rubber is relatively free from oxidative degradation.

20. The pressure roll of claim 19 wherein the outer protective sleeve material is selected from the group consisting of fluorinated ethylene propylene resin, a copolymer of vinylidene fluoride and hexafluoropropylene, a copolymer of perfluoroalkyl perfluorovinyl ether with tetrafluoroethylene, and polytetrafluoroethylene.

* * * * *